US007129190B2

(12) United States Patent
Takahashi et al.

(10) Patent No.: US 7,129,190 B2
(45) Date of Patent: Oct. 31, 2006

(54) FIBER ARTICLE COMPRISING A BIODEGRADABLE PLASTIC

(75) Inventors: Ikuo Takahashi, Chiba (JP); Hirotaka Iida, Chiba (JP)

(73) Assignee: Nisshinbo Industries, Inc., Tokyo (JP)

( * ) Notice: Subject to any disclaimer, the term of this patent is extended or adjusted under 35 U.S.C. 154(b) by 0 days.

(21) Appl. No.: 11/051,462

(22) Filed: Feb. 7, 2005

(65) Prior Publication Data

US 2005/0233142 A1 Oct. 20, 2005

(30) Foreign Application Priority Data

Feb. 12, 2004 (JP) ..... 2004-034941

(51) Int. Cl.
*D01F 6/00* (2006.01)

(52) U.S. Cl. ..... 442/181; 428/357

(58) Field of Classification Search ..... 428/364, 428/357; 442/181; 474/267
See application file for complete search history.

(56) References Cited

U.S. PATENT DOCUMENTS

| | | | | |
|---|---|---|---|---|
| 4,351,936 | A * | 9/1982 | Matsumura et al. | 528/289 |
| 4,891,040 | A * | 1/1990 | Nagai et al. | 474/267 |
| 5,308,697 | A * | 5/1994 | Muramoto et al. | 428/373 |
| 5,407,581 | A * | 4/1995 | Onodera et al. | 210/654 |
| 6,007,911 | A * | 12/1999 | Bowen, Jr. | 428/373 |
| 6,107,378 | A * | 8/2000 | Imashiro et al. | 524/195 |
| 6,705,353 | B1 * | 3/2004 | Hotta et al. | 139/421 |
| 6,761,970 | B1 * | 7/2004 | Ochi et al. | 428/364 |
| 6,846,860 | B1 * | 1/2005 | Takahashi et al. | 524/128 |
| 6,866,934 | B1 * | 3/2005 | Takahashi et al. | 428/402 |

FOREIGN PATENT DOCUMENTS

| | | |
|---|---|---|
| EP | 1 354 917 A | 10/2003 |
| JP | 7-316273 | 12/1995 |
| JP | 9-21017 | 1/1997 |
| JP | 11-80522 | 3/1999 |
| JP | 2000-80531 A | 3/2000 |
| JP | 2001-123348 A | 5/2001 |
| JP | 2001-261797 | 9/2001 |
| JP | 2002-227050 A | 8/2002 |
| JP | 2003-301327 | 10/2003 |

* cited by examiner

*Primary Examiner*—N. Edwards
(74) *Attorney, Agent, or Firm*—Westerman, Hattori, Daniels & Adrian, LLP.

(57) ABSTRACT

A fiber article having excellent hydrolysis resistance, characterized in that the article is fiber structure composed of 10 to 90% by weight of a fiber (A) comprised of a biodegradable plastic formulated with a carbodiimide compound as a stabilizer against hydrolysis and 90 to 10% by weight of at least one fiber (B) selected from a natural fiber, a regenerated fiber, a semi-synthetic fiber and a synthetic fiber, which fiber structure has been subjected to at least one treatment processing selected from scouring processing, bleaching processing, liquid ammonium processing, mercerization processing, biological processing, dyeing processing, or resin treatment, and concentration of total terminal carboxyl groups derived from the fiber (A) in said fiber article is not higher than 30 equivalents/ton based on the fiber (A), etc. It is an object of the present invention to solve conventional problems of a fiber or a fiber article comprising a biodegradable plastic, such as poor hydrolysis resistance, poor heat resistance, strength reduction and coloring by yellowing, and in particular to provide a fiber article superior in hydrolysis resistance, alkali resistance and dyeing resistance.

9 Claims, No Drawings

FIBER ARTICLE COMPRISING A BIODEGRADABLE PLASTIC

BACKGROUND OF THE INVENTION

1. Field of the Invention

The present invention relates to a fiber article having excellent hydrolysis resistance and containing a biodegradable plastic, and more specifically relates to a fiber article having excellent hydrolysis resistance, alkali resistance, and dyeing resistance, by formulating a stabilizer against hydrolysis comprising a carbodiimide compound to a fiber using a biodegradable plastic.

2. Description of the Prior Art

As a biodegradable plastic degradable by an enzyme or a microbe, an aliphatic polyester is noted, and as the biodegradable aliphatic polyester, polylactic acid, polyglycolic acid, poly(3-hydroxybutylate), poly(3-hydroxybutylate-3-hydroxyvalerate), polycaprolactone, and a polyester comprising a glycol such as ethylene glycol, 1,4-butanediol, and the like and a carboxylic acid such as succinic acid, adipic acid, and the like are known.

However, these aliphatic polyesters have very high hydrolytic property in water at room temperature or high temperature, and further have tendency to be degradable even by moisture in atmosphere. Due to the above nature to be easily degradable, there were various problems as follows. For instance, when they are used as fibers, dyeing at high temperature in an aqueous solution dispersed with dye abruptly decreases tear strength of a cloth, and thus only dyeing under comparatively low temperature condition is allowed, which in turn makes deep color dyeing impossible. Furthermore, when they are used in water for marine materials such as a fishermen's net, service life thereof is limited to extremely short period. Furthermore, since they have poor stability with elapse of time, they cannot exhibit initial performance owing to deterioration after elapse of long period after production.

To solve such problems as above, technique to cap terminal carboxylic groups of polylactic acid, which is a sort of an aliphatic polyester, by a condensation reaction with an aliphatic alcohol, is disclosed (for example, see JP-A-7-316273 (Claims and the like)).

However, the technique of capping terminal ends is a condensation reaction, and to remove reaction byproducts, it is necessary to the presence of an aliphatic alcohol together in polymerization of the polylactic acid, and there have been such problems as follows. Polymerization rate thereof is low, and accordingly industrial production is impossible, or many unreacted materials having low molecular weight reside, and since they vaporize in molding, appearance of a molded article is inferior, or thermal resistance of the article is poor. Further, there has been such a problem as, during re-melting and molding a polymer (a chip) having capped terminals, which polymer has been obtained by a condensation reaction, terminal carboxylic groups are regenerated, and uncapped terminal ends occur, which makes hydrolysis resistance of molded articles insufficient.

Moreover, technique is disclosed to decrease concentration of terminal carboxylic groups of polylactic acid fiber, by lowering spinning temperature, in addition to capping of terminal carboxylic groups with an aliphatic alcohol (for example, see JP-A-9-21017 (Claims and the like)).

However, because melt viscosity of an aliphatic polyester represented by polylactic acid has relatively high dependency on temperature, there has been a problem that it is necessary to decrease molecular weight of a polymer sufficiently in response to spinning at low temperature, and thus polylactic acid fiber having sufficiently high strength as a commonly used fiber, and the like cannot be available.

On the other hand, to improve hydrolysis resistance, technique to formulate a carbodiimide compound with a biodegradable plastic, is disclosed (for example, see JP-A-11-80522 (Claims and the like)).

However, with a mono-carbodiimide compound disclosed in Patent Reference 3, there has been such a problem as insufficient thermal resistance, that means, thermal degradation is apt to occur during processing, which causes environmental pollution owing to occurrence of stimulative smell components and decrease in the addition effect owing to vaporization.

To improve this, a polycarbodiimide compound is used, but there was a problem of coloring (yellowing) in processing, and therefore it has been difficult to use in applications where hue is made much of (for example, use of a fiber for clothing).

Further, when a fiber comprising a biodegradable plastic is processed for dyeing, there has been such a problem as remarkable decrease in strength of the fiber comprising a biodegradable plastic.

From such situations, some proposals have been made to improve hydrolysis resistance of a biodegradable plastic or a fiber comprising the same. For instance, an aliphatic polyester resin such as polylactic acid and a molded article such as a fiber or a film comprising the same, characterized in that a part of or substantially whole of terminal carboxyl groups in an aliphatic polyester is capped with a mono-carbodiimide compound having temperature of 5 wt % decrease of not lower than 170° C. as measured by TG-DTA (for instance, concentration of terminal carboxyl groups is not higher than 10 equivalents/$10^3$ kg of an aliphatic polyester) (see JP-A-2001-261797 (Claims and the like)); and a fiber of polylactic acid having excellent hydrolysis resistance, wherein terminal carboxyl groups thereof are capped with a poly-carbodiimide compound, characterized in that b* value, which is an index of color tone, is not higher than 7 (see JP-A-2003-301327 (Claims and the like)), are disclosed.

However, with an aromatic mono-carbodiimide compound as disclosed in JP-A-2001-261797 (Claims and the like), weatherability to sunshine, and the like is poor, which means unpractical. And in a fiber of polylactic acid wherein terminal carboxyl groups thereof are capped with a poly-carbodiimide compound as disclosed in JP-A-2003-301327 (Claims and the like), a problem of poor thermal stability (or thermal resistance) in fiber production is adjusted by spinning condition and by the addition amount of a poly-carbodiimide compound, however, this method had still a problem that appropriate condition range was narrow, resulting in not stable quality, and additionally insufficient levels of color hue stability (for example, yellowing) and hydrolysis resistance, which brought about no durability in dyeing processing of a fiber article conducted under the above-described acid and alkali conditions. There was also a problem of insufficient durability after producing an article.

Moreover, in the case of a fiber article by combination of a biodegradable plastic and a cellulose fiber, and the like, applying chances of liquid ammonium processing, silket processing (mercerization processing), dyeing processing, or bleaching processing seem to increase. However, with these processings, treatment with an alkali, an acid, chlorine, heat, and the like increases and especially by passing an alkali processing step, such a problem may happen as significant decrease in strength of a fiber article comprising a biodegradable plastic.

As above, conventionally, attempts to improve hydrolysis resistance have been challenged by decreasing concentration of terminal carboxyl groups in an aliphatic polyester, such as polylactic acid, but a fiber or a fiber article comprising an aliphatic polyester having both sufficient thermal resistance and hydrolysis resistance has not yet been attained.

SUMMARY OF THE INVENTION

Accordingly, it is an object of the present invention to solve problems of poor hydrolysis resistance, poor thermal resistance and decrease in strength, and a coloring problem due to yellowing, which have been conventional problems of a biodegradable plastic fiber or an article thereof, and to provide a fiber article having especially excellent hydrolysis resistance, alkaline resistance and dyeing resistance.

The inventors of the present invention have found, after having intensive study to overcome the problems involved in the above-described conventional techniques, that a fiber article using a biodegradable plastic fiber remarkably decreases its strength by treatment processing such as liquid ammonium processing, silket processing (mercerization processing) or dyeing processing, however, the problem of decrease in strength in treatment processing can be solved by the addition of a carbodiimide compound to a biodegradable plastic, and by using a stabilizer against hydrolysis comprising a specified carbodiimide compound, extremely excellent color hue stability can be exhibited, namely yellowing is suppressed, hydrolysis resistance is improved, and further a fiber article, which can be suitably used in treatment processing, such as liquid ammonium processing, mercerization processing or dyeing processing, is obtained. The present invention has been accomplished based on the above knowledge.

Namely, the first aspect of the present invention provides a fiber article having excellent hydrolysis resistance, characterized in that the article is fiber structure composed of 10 to 90% by weight of a fiber (A) comprised of a biodegradable plastic formulated with a carbodiimide compound as a stabilizer against hydrolysis and 90 to 10% by weight of at least one fiber (B) selected from a natural fiber, a regenerated fiber, a semisynthetic fiber and a synthetic fiber, which fiber structure has been subjected to at least one treatment processing selected from scouring processing, bleaching processing, liquid ammonium processing, mercerization processing, biological processing, dyeing processing and resin treatment, and concentration of total terminal carboxyl groups derived from the fiber (A) in said fiber article is not higher than 30 equivalents/ton based on the fiber (A).

The second aspect of the present invention provides, in the first aspect, the fiber article having excellent hydrolysis resistance, characterized in that concentration of total terminal carboxyl groups in the fiber (A) is not higher than 1 equivalent/ton based on the fiber (A).

The third aspect of the present invention provides, in the first aspect, the fiber article having excellent hydrolysis resistance, characterized in that the stabilizer against hydrolysis has yellow index (YI value) of not higher than 10.

The fourth aspect of the present invention provides, in the third aspect, the fiber article having excellent hydrolysis resistance, characterized in that the carbodiimide compound is an aliphatic polycarbodiimide compound.

The fifth aspect of the present invention provides, in the first aspect, the fiber article having excellent hydrolysis resistance, characterized in that the stabilizer against hydrolysis further contains an antioxidant.

The sixth aspect of the present invention provides, in the fifth aspect, the fiber article having excellent hydrolysis resistance, characterized in that the antioxidant is at least one-kind of a hindered phenol type antioxidant or a phosphorus type antioxidant.

The seventh aspect of the present invention provides, in the first aspect, the fiber article having excellent hydrolysis resistance, characterized in that the stabilizer against hydrolysis is formulated in ratio of 0.01 to 5 parts by weight based on 100 parts by weight of the biodegradable plastic.

The eighth aspect of the present invention provides, in the first aspect, the fiber article having excellent hydrolysis resistance, characterized in that the biodegradable plastic is an aliphatic polyester.

The ninth aspect of the present invention provides, in the first aspect, the fiber article having excellent hydrolysis resistance, characterized in that the biodegradable plastic is one obtained from a biomass raw material.

As described above, the present invention relates to a fiber article having excellent hydrolysis resistance, characterized in that the article is fiber structure composed of a fiber (A) comprising a biodegradable plastic formulated with a carbodiimide compound as a stabilizer against hydrolysis and at least one fiber (B) selected from a natural fiber, a regenerated fiber, a semisynthetic fiber or a synthetic fiber, whose fiber structure has been subjected to treatment processings such as scouring processing, and concentration of total terminal carboxyl groups derived from the fiber (A) in said fiber article is not higher than 30 equivalents/ton. The preferred embodiments include the followings:

(1) The fiber article having excellent hydrolysis resistance in the first aspect of the present invention, characterized in that concentration of total terminal carboxyl groups derived from the fiber (A) in said fiber article is not higher than 1 equivalent/ton based on the fiber (A).

(2) The fiber article having excellent hydrolysis resistance in the fourth aspect of the present invention, characterized in that the aliphatic type polycarbodiimide compound is an aliphatic polycarbodiimide compound having polymerization degree of not smaller than 5.

(3) The fiber article having excellent hydrolysis resistance in the fifth aspect of the present invention, characterized in that formulation ratio of the carbodiimide compound and the antioxidant in the stabilizer against hydrolysis is such that the latter is 0.01 to 20 parts by weight based on 100 parts by weight of the former.

(4) The fiber article having excellent hydrolysis resistance in the fifth aspect of the present invention, characterized in that the stabilizer against hydrolysis is mixed with an antioxidant during synthesis of the carbodiimide compound.

(5) The fiber article having excellent hydrolysis resistance in the sixth aspect of the present invention, characterized in that the hindered phenol type antioxidant is pentaerythritol tetrakis-[3-(3,5-di-t-butyl-4-hydroxyphenyl) propionate].

(6) The fiber article having excellent hydrolysis resistance in the sixth aspect of the present invention, characterized in that the phosphorus type antioxidant has pentaerythritol structure.

(7). The fiber article having excellent hydrolysis resistance in the sixth aspect of the present invention, characterized in that the phosphorus type antioxidant has, in addition to pentaerythritol structure, further an aromatic hydrocarbon group possessing a t-butyl group.

(8) The fiber article having excellent hydrolysis resistance in any of the sixth aspect or the above-described embodiment (7) of the present invention, characterized in that the phosphorus type antioxidant is bis-(2,4-di-t-butylphenyl) pentaerythritol diphosphite or bis-(2,6-di-t-butyl-4-methylphenyl) pentaerythritol diphosphite.

(9) The fiber article having excellent hydrolysis resistance in the ninth aspect of the present invention, characterized in that the biodegradable plastic is polylactic acid (polylactide) type aliphatic polyester.

Conventionally, a fiber or a fiber article comprising a biodegradable plastic had problems of decrease in hydrolysis resistance, thermal resistance and strength, and a coloring problem by yellowing. However, a fiber article having excellent hydrolysis resistance employing a biodegradable plastic fiber according to the present invention, by formulating a specific stabilizer against hydrolysis to a biodegradable plastic fiber, can solve the above-described conventional problems, even when treatment processing such as liquid ammonium processing, mercerization processing, and the like is applied, and has effect of exhibiting especially excellent hydrolysis resistance, alkaline resistance and dyeing resistance.

DETAILED DESCRIPTION OF THE INVENTION

The present invention is described below in detail by each item.

The fiber article having excellent hydrolysis resistance according to the present invention is characterized in that the article is fiber structure composed of 10 to 90% by weight of a fiber (A) comprising a biodegradable plastic formulated with a carbodiimide compound as a stabilizer against hydrolysis and 90 to 10% by weight of at least one fiber (B) selected from a natural fiber, a regenerated fiber, a semisynthetic fiber or a synthetic fiber, which fiber structure has been subjected to at least one treatment processing selected from scouring processing, bleaching processing, liquid ammonium processing, mercerization processing, biological processing, dyeing processing and resin treatment, and concentration of total terminal carboxyl groups derived from the fiber (A) in said fiber article is not higher than 30 equivalents/ton.

I. Fiber (A)

1. A Stabilizer Against Hydrolysis

A stabilizer against hydrolysis comprises a carbodiimide compound, preferably an aliphatic type carbodiimide compound. It preferably comprises a carbodiimide composition of a carbodiimide compound and an antioxidant, more preferably a carbodiimide composition characterized by mixing an antioxidant during synthesis of the aliphatic type carbodiimide compound and making it disperse and reside therein.

1.1 A Carbodiimide Compound

As a carbodiimide compound having at least one carbodiimide group in a molecule, used in the present invention, those synthesized by a commonly well known method may be used.

For example, a carbodiimide compound may be synthesized by subjecting various kinds of polyisocyanates to a decarboxylation condensation reaction with an organophosphorus compound or an organometal compound as a catalyst, at temperature of not lower than about 70° C., in an inert solvent or without using any solvent.

As a monocarbodiimide compound which can be used in the present invention, such as N,N'-diphenylcarbodiimide and N,N'-di-2,6-diisopropylphenylcarbodiimide are exemplified.

In the present invention, a polycarbodiimide compound can also be used suitably. A polycarbodiimide compound includes those produced by various methods can be used Basically, polycarbodiimide compounds can be used, which are manufactured by conventional methods for manufacturing polycarbodiimide [for example, U.S. Pat. No. 2,941,956, JP-B-47-33279, J. Org. Chem., 28, 2,069–2,075 (1963) and Chemical Review 1981, Vol. 81, No. 4, p619–621].

As an organic diisocyanate which is a raw material for producing a polycarbodiimide compound used in the present invention, an aromatic diisocyanate, an aliphatic diisocyanate, an alicyclic diisocyanate, and a mixture thereof can be used.

An aromatic diisocyanate includes, for example, 1,5-naphthalene diisocyanate, 4,4'-diphenylmethane diisocyanate, 4,4'-diphenyldimethylmethane diisocyanate, 1,3-phenylene diisocyanate, 1,4-phenylene diisocyanate, 2,4-tolylene diisocyanate, 2,6-tolylene diisocyanate, a mixture of 2,4-tolylene diisocyanate and 2,6-tolylene diisocyanate, xylylene diisocyanate, tetramethylxylylene diisocyanate, 2,6-diisopropylphenyl isocyanate, 1,3,5-triisopropylbenzene-2,4-diisocyanate, and the like.

An aliphatic diisocyanate includes such as hexamethylene diisocyanate, etc.

An alicyclic diisocyanate includes such as cydohexane-1,4-diisocyanate, isophorone diisocyanate, dicydohexylmethane-4,4'-ciisocyanate, methylcydohexane diisocyanate, etc.

In addition, in the case of the above-described polycarbodiimide compound, degree of polymerization can be adequately controlled by quenching a polymerization reaction in the midst of the reaction by cooling or the like. In this case, the terminal group becomes isocyanate. Another method for adequately controlling degree of polymerization is to cap all or a part of remaining terminal isocyanate groups using a reactive compound with terminal isocyanate groups of a polycarbodiimide compound such as a monoisocyanate. Control of degree of polymerization is preferable from the viewpoint of quality improvement, due to providing improved compatibility to a polymer or enhanced storage stability.

Such a monoisocyanate to control degree of polymerization by capping terminal groups of a polycarbodiimide compound includes, for example, phenyl isocyanate, tolylisocyanate, dimethylphenyl isocyanate, cyclohexyl isocyanate, butyl isocyanate, etc.

Further, a terminal-capping agent to control the degree of polymerization by capping terminal groups of a polycarbodiimide compound is not limited to the above-described monoisocyanates, but also includes an active hydrogen compounds reactive with isocyanate, such as (i) an aliphatic, aromatic or alicyclic compound having—OH group such as methanol, ethanol, phenol, cyclohexanol, N-methylethanolamine, polyethylene glycol monomethyl ether and polypropylene glycolmonomethyl ether; (ii) a compound having a═NH group such as diethylamine and dicyclohexylamine; (iii) a compound having a═NH2 group such as butylamine and cydohexylamine; (iv) a compound having a—COOH group such as succinic acid, benzoic acid and cydohexanecarboxylic acid; (v) a compound having a—SH group such as ethylmercaptan, allylmercaptan and thiophenol; and (vi) a compound having an epoxy group; (vii) acetic anhydride, methyltetrahydrophthalic anhydride and methylhexahydrophthalic anhydride. Among these compounds, those having —OH group are desirable as less yellowing structures.

The decarboxylation condensation reaction of the above-described organic diisocyanate is performed in the presence of a suitable carbodiimidation catalyst. As the carbodiimidation catalyst to be used, an organophosphorus compound and an organometallic compound [a compound expressed by general formula $M-(OR)_4$, wherein M is titanium (Ti), sodium (Na), potassium (K), vanadium (V), tungsten (W), hafnium (Hf), zirconium (Zr), lead (Pb), manganese (Mn), nickel (Ni), calcium (Ca) and barium (Ba) and the like; R is alkyl group or aryl group having carbon atoms of 1 to 20] are preferable, and phospholeneoxide among organophosphorus compounds and alkoxides of titanium, hafnium and zirconium among organometallic compounds are particularly preferable from the viewpoint of activity.

The above-described phospholene oxides include specifically, 3-methyl-1-phenyl-2-phospholene-1-oxide, 3-methyl-1-ethyl-2-phospholene-1-oxide, 1,3-dimethyl-2-phospholene-1-oxide, 1-phenyl-2-phospholene-1-oxide, 1-ethyl-2-phospholene-1-oxide, 1-methyl-2-phospholene-1-oxide and double bond isomers thereof. Among them, 3-methyl-1-phenyl-2-phospholene-1-oxide is particularly preferable because of easiness in industrial availability.

According to the present inventors, when a stabilizer against hydrolysis of the present invention is compounded in a biodegradable plastic, a carbodiimide compound plays a role to control hydrolysis, in the initial stage after the addition, by reacting with a hydroxyl group and a carboxyl group remaining in a biodegradable plastic resin and after that, by bonding to the linkages of a biodegradable plastic cleaved by the hydrolysis reaction to recombine them.

A carbodiimide compound for this purpose preferably includes an aliphatic carbodiimide compound having not less than one carbodiimide group in a molecule such as 4,4'-dicyclohexylmethanecarbodiimide (degree of polymerization=2 to 20). Degree of polymerization of an aliphatic carbodiimide compound is preferably not lower than 5, in view of heat resistance. Further, an aliphatic carbodiimide compound has preferably, in particular, isocyanate terminal groups from the viewpoint of stability against hydrolysis.

1.2. An Antioxidant

An antioxidant used in combination, preferably in synthesis of a carbodiimide compound of the present invention is preferably a phosphorus antioxidant it self, a hindered phenol antioxidant itself or said phosphorus antioxidant and a hindered phenol antioxidant in combined use.

The feature of the present invention is that an antioxidant is added to a carbodiimide compound during synthesis thereof, or an antioxidant is admixed into raw materials of a carbodiimide compound in advance. By this procedure, a carbodiimide compound and an antioxidant can be homogeneously dispersed and present.

Further, in the present invention, in addition to a method for admixing an antioxidant during synthesis of a carbodiimide compound, a carbodiimide composition may also be used as a stabilizer against hydrolysis by sufficiently mixing or kneading a carbodiimide compound after synthesis with particularly a phosphorus antioxidant.

As a carbodiimide compound used in combination with an antioxidant, an aliphatic carbodiimide compound is preferable in view of weatherability, safety, stability and, in particular, color hue.

A phosphorus antioxidant includes such as tris(2,4-di-t-butylphenyl) phosphite (Trade Name: Irgaphos 168 from Ciba Specialty Chemicals Ltd., Trade Name: Adekastab 2112 from Asahi Denka Kogyo K.K., etc.), bis(2,4-di-t-butylphenyl)pentaerythritol diphosphite (Trade Name: Irgaphos 126 from Ciba Specialty Chemicals Ltd., Trade Name: Adekastab PEP-24G from Asahi Denka Kogyo K.K., etc.), bis(2,6-di-t-butyl-4-methylphenyl)pentaerythritol diphosphite (Trade Name: Adekastab PEP-36 from Asahi Denka Kogyo K.K.) and distearyl pentaerythritol diphosphite (Trade Name: Adekastab PEP-8 from Asahi Denka Kogyo K.K., Trade Name: JPP-2000 from Johoku Chemical Co., Ltd., and the like). A phosphorus antioxidant has preferably pentaerythritol structure from the viewpoint of improvement in stability against hydrolysis, and particularly preferably an aromatic hydrocarbon group having a t-butyl group in addition to pentaerythritol structure.

As a particularly preferable example of a phosphorus antioxidant, chemical formula of bis(2,6-di-t-butyl-4-methylphenyl)pentaerythritol diphosphite (Trade Name: Adekastab PEP-36 from Asahi Denka Kogyo K.K.) is shown below.

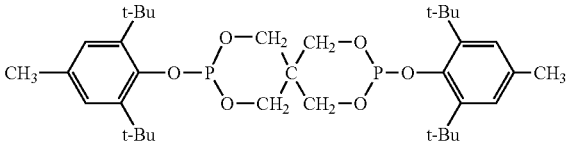

Further, a hindered phenol type antioxidant preferably used in combination with the above-described phosphorus antioxidant has molecular weight of preferably not lower than 400 from the viewpoint of heat resistance. On the other hand, lower molecular weight may cause phenomena such as scattering, volatilization or extraction by a substance in contact therewith. In particular, since migration of an antioxidant into foods from plastic material in contact with foods may cause a sanitary problem, molecular weight of preferably not lower than 400, more preferably not lower than 500 is used in the present invention. In addition, by selecting a hindered phenol type antioxidant having higher molecular weight, an effect of improving heat resistance can be provided.

Such a hindered phenol type antioxidant having molecular weight of not lower than 400 includes, for example, 4,4'-methylene-bis-(2,6-di-t-butylphenol) (MW=420), octadecyl-3-(3,5'-di-t-butyl-4-hydroxyphenyl)propionate (MW=531) (Trade Name: "Irganox 1076" from Ciba Specialty Chemicals Ltd.), pentaerythritoltetrakis[3-(3,5-di-t-butyl-4-hydroxyphenyl)propionate] (MW=1,178) (Trade Name: "Irganox 1010" from Ciba Specialty Chemicals Ltd.), 3,9-bis{2-[3-(3-tert-butyl-4-hydroxy-5-methylphenyl)propionyloxy]-1,1-dimethylethyl}-2,4,8,10-tetraoxaspiro[5,5]undecane (MW=741) (Trade Name: "Sumilizer GA-80" from Sumitomo Chemical Co., Ltd.).

As described above, an antioxidant used in the present invention is added during synthesis of a carbodiimide compound. By this procedure, coloring of a carbodiimide compound in synthesis thereof can be suppressed, and coloring of a carbodiimide compound, when added to a biodegradable plastic, can also be suppressed. An antioxidant can be used in the amount effective to provide improvements in stability against hydrolysis and heat resistance.

Thus, the total amount of an antioxidant to be compounded is preferably 0.01 to 20 parts by weight, and particularly preferably 0.1 to 10 parts by weight to 100 parts by weight of a carbodiimide compound. An amount of an antioxidant to be compounded less than 0.01 part by weight gives poor effect in preventing coloring in carbodiimide synthesis or preventing coloring during the addition to a biodegradable plastic. On the other hand, an amount over 20 parts by weight causes such problems as to lower reaction rate in a carbodiimide synthesis or to make an antioxidant hardly compatible to a carbodiimide compound.

In the case when a hindered phenol type antioxidant and a phosphorus antioxidant are used in combination as antioxidants, a ratio by weight of a hindered phenol antioxidant to a phosphorus antioxidant is preferably in the range from 5:1 to 1:5.

In addition, an antioxidant to be compounded into plastics may also include antioxidants other than the above-described hindered phenol type antioxidants and phosphite type of antioxidants (phosphorus antioxidants), for example, aromatic amines such as diphenyl amine and phenyl-α-naphthyl amines and sulfur-containing antioxidants. These antioxidants may be used within the amount not to impair the effect of the present invention. For example, a small amount of an aromatic amine type antioxidant can be used in combination, in addition to the above-described hindered phenol or phosphite type antioxidants. However, these aromatic amine type antioxidants or the like must be compounded carefully because it may cause easy coloring.

1.3. A Carbodiimide Composition

As described above, a carbodiimide composition of the present invention comprises carbodiimide compound and an antioxidant, and preferably has not lower than 250° C. of TG 5% weight loss temperature as determined by a thermogravimetric (TG) method (a thermobalance analysis method) from the viewpoint of heat resistance, and Yellow Index (YI) of not higher than 10, preferably not higher than 8 from the view point of preventing yellowing. Thus, a carbodiimide composition of the present invention can suitably used even in garment application, wherein color hue is an important point. Yellow Index (YI) in the present invention is measured and evaluated in accordance with JIS K7103, "A test method for yellow index and degree of yellowing of plastics".

In the present invention, an antioxidant may preferably be admixed into a carbodiimide compound, as described above, in synthesis of a carbodiimide compound, such as in the midst of a reaction of carbodiimide compound synthesis or during a raw material charging step in carbodiimide compound synthesis, but it may be admixtured to a carbodiimide compound after synthesis.

A carbodiimide composition can suitably be used as a stabilizer against hydrolysis of a biodegradable plastic.

In addition, for example, carbodiimide composition admixed with a phosphorus antioxidant during synthesis of carbodiimide compound, may be suitably compounded with further a phosphorus antioxidant or further a phenol antioxidant, if necessary.

In this case, total amount of said antioxidants including a phosphorus antioxidant further added is, as described above, preferably 0.01 to 20 parts by weight, particularly preferably 0.1 to 10 parts by weight to 100 parts by weight of an carbodiimide compound in a carbodiimide composition.

In the present invention, such a carbodiimide composition also includes as one obtained by further compounding a phosphorus antioxidant or the like to carbodiimide compound already admixed with a phosphorus antioxidant during synthesis thereof.

A phosphorus antioxidant that may be suitably compounded in a carbodiimide composition, if necessary, includes, for example, tris-(2,4-di-t-butylphenyl)phosphite (Trade Name: "Irgaphos 168" from Ciba Specialty Chemicals Ltd., Trade Name: "Adekastab 2112" from Asahi Denka Kogyo K.K., etc.), bis-(2,4-di-t-butylphenyl)pentaerythritol-diphosphite (Trade Name: "Irgaphos 126" from Ciba Specialty Chemicals Ltd., Trade Name: "Adekastab PEP-24G" from Asahi Denka Kogyo K.K., etc.), bis-(2,6-di-t-butyl-4-methylphenyl)pentaerythritol-diphosphite (Trade Name: "Adekastab PEP-36" from Asahi Denka Kogyo K.K.), distearyl-pentaerythritol-diphosphite (Trade Name: "Adekastab PEP-8" from Asahi Denka Kogyo K.K., Trade Name: "JPP-2000" from Johoku Chemical Co., Ltd., etc.), similarly to the phosphorus antioxidant described above. A phosphorus antioxidant has preferably pentaerythritol structure from the viewpoint of improvement in stability against hydrolysis, and particularly preferably an aromatic hydrocarbon group having a t-butyl group in addition to pentaerythritol structure.

These hindered phenol antioxidants and phosphorus antioxidants may be compounded in a carbodiimide compound as they are or in combination.

2. A Biodegradable Plastic

A biodegradable plastic used in a fiber (A) in the present invention includes, for example, polyesters metabolized by microorganisms, and among them, preferably aliphatic polyesters which can easily be metabolized by microorganisms.

Generally, in a biodegradable plastic, biodegradation is said to proceed by the following processes.

Namely, in decomposition of a polymer material (a biodegradable plastic) discharged in environment:

(i) Firstly, a polymer decomposition enzyme adsorbs on the surface of a polymer material. This enzyme is such one as extracellularly secreted by a specific kind of microorganism. (ii) Then, the enzyme cleaves chemical bonds such as ester, glycoside and peptide linkages in polymer chains by hydrolysis reaction. (iii) As a result, polymer material is further decomposed up to a monomer unit level by the decomposition enzyme with decrease in molecular weight. (iv) Finally, decomposed products are further metabolized and consumed to be converted to carbon dioxide, water and cell components, etc. by various microorganisms.

Aliphatic polyesters easily metabolized by microorganism via hydrolysis reaction include:

(1) Polylactic acid (polylactide) type aliphatic polyesters
(2) Condensate type aliphatic polyesters from polyvalent alcohols/polybasic acids
(3) Aliphatic polyesters produced by microorganisms such as polyhydroxybutyrate (PHB) and
(4) Polycaprolactone (PCL) type aliphatic polyesters In the present invention, any kind of the above-described aliphatic polyesters can be preferably used as a biodegradable plastic, however, polylactic acid (polylactide) type aliphatic polyesters derived from biomass raw materials are particularly preferable.

Further, in the present invention, a biodegradable plastic is not limited to the above-described aliphatic polyesters, and other biodegradable plastics can also be used as long as they have chemical bonds such as ester, glycoside and peptide linkages, where polymer chains in a biodegradable plastic are cleaved by hydrolysis reaction. Such plastics include, for example, a carbonate copolymer of an aliphatic polyester in which carbonate structure is randomly introduced in a skeletal molecular chain of an aliphatic polyester, and a copolymer of aliphatic polyester and polyamide, having an amide linkage, by introduction of nylon in molecular skeleton of an aliphatic polyester.

Hereinbelow, an aliphatic polyester will be described in more detail.

(1) Polylactic Acid (polylactide) Type Aliphatic Polyesters

Polylactic acid (polylactide) type aliphatic polyesters include polylactides, more specifically, a polymer of oxyacids such as lactic acid, malic acid and glycolic acid, or a copolymer thereof, for example, polylactic acid, poly(α-malic acid), polyglycolic acid and a glycolic acid/lactic acid copolymer, and particularly hydroxycarboxylic acid type aliphatic polyester represented by polylactic acid.

The above-described polylactic acid type aliphatic polyesters can be obtained generally by a so-called lactide method, which is a ring opening polymerization method for lactide as a cyclic diester or a corresponding lactones, or by a direct dehydration condensation method for lactic acid and a polycondensation method between formalin and carbon dioxide, as a method other than a lactide method.

Catalysts for manufacturing the above-described polylactic add type aliphatic polyester include, for example, compounds of tin, antimony, zinc, titanium, iron and aluminum. Among them, preferable catalysts are tin-based and aluminum-based catalysts, and particularly preferable catalysts are tin octyl acid and aluminum acetylacetonate.

Among the above-described polylactic acid type aliphatic polyesters, poly-L-lactic acid obtained by a ring opening polymerization of lactide is preferable, because it is hydrolyzed to L-lactic acid whose safety has been confirmed. However, a polylactic acid type aliphatic polyester used in the present invention is not limited to poly-L-lactic acid, and therefore, lactide used for manufacturing thereof is not limited to L-isomer thereof. Even a composition composed of L-isomer, D-isomer and meso-form in an arbitrary ratio can be used, but a ratio of any one isomer unit must be not lower than 90%, when the composition is required to be crystalline and has high melting point and enhanced mechanical properties and heat resistance.

(2) Aliphatic Polyester as a Product of Condensation Reaction of Polyvalent Alcohols and Polybasic Acids.

Examples of the aliphatic polyester as a product of condensation reaction of polyvalent alcohols and polybasic acids include an aliphatic glycol/polybasic acid type polyester obtained by reacting aliphatic glycols with an aliphatic polybasic acid (or anhydride thereof) in the presence of a catalyst, or a high molecular weight of aliphatic glycol/polybasic acid type polyester obtained by reacting using a small amount of coupling agent, if necessary.

The aliphatic glycols for producing the aliphatic glycol/polybasic acid type polyester used in the present invention include, for example, ethylene glycol, 1,4-butanediol, 1,6-hexanediol, decamethylene glycol, neopentyl glycol and 1,4-cyclohexanedimethanol, and ethylene oxide can also be used. In this connection, these glycols may be used in combination of two or more types thereof.

As the aliphatic polybasic adds and the anhydrides thereof to form the aliphatic glycol/polybasic add type polyester by reacting with the above-described aliphatic glycols, such compounds as succinic add, adipic add, suberic add, sebacic add, dodecanic add, and succinic anhydride and adipic anhydride are generally available in the market, and can be used. In this connection, these polybasic adds and anhydrides thereof may be used in combination of two or more types thereof.

The above-described glycols and polybasic acids are of aliphatic types, but a small amount of other components, for example, aromatic glycols and aromatic polybasic adds such as trimellitic anhydride and pyromellitic anhydride can be used in combination with the above-described glycols and polybasic adds. However, an amount of the aromatic glycol or the aromatic polybasic add to be incorporated should not be higher than 20 parts by weight, preferably not higher than 10 parts by weight, and more preferably not higher than 5 parts by weight, based on 100 parts by weight of the aliphatic glycols, because the incorporation of these aromatic components deteriorates the biodegradability.

In addition, examples of a catalyst to produce the above-described aliphatic glycol/polybasic add type polyester are salts of organic acids, alkoxides and oxides of such metals as titanium, tin, antimony, cerium, zinc, cobalt, iron, lead, manganese, aluminum, magnesium and germanium, and among them, a tin-based or an aluminum-based compound is preferable.

The above-described aliphatic glycol/polybasic acid type polyester may be produced by reacting an equivalent amount of the aliphatic glycol and the aliphatic polybasic acid together with the catalyst by heating, using a solvent appropriately selected depending on raw material compounds, if necessary, and a prepolymer with a low degree of polymerization can be produced by controlling the progress of the reaction.

In the production of the above-described aliphatic glycol/polybasic acid type polyester, a coupling agent can be used, in particular, for the prepolymer with low degree of polymerization, to further increase a number average molecular weight thereof. Examples of said coupling agent include diisocyanate, oxazoline, diepoxy compounds and acid anhydrides, and particularly diisocyanate is preferably used.

The diisocyanate as the above-described coupling agent is not specifically limited in type, but includes 2,4-tolylene diisocyanate, mixture of 2,4-tolylene diisocyanate and 2,6-tolylene diisocyanate, diphenylmethane diisocyanate, 1,5-naphthalene diisocyanate, xylylene diisocyanate, hydrogenated xylylene diisocyanate, hexamethylene diisocyanate, isophorone diisocyanate and 4,4'-dicyclohexylmethane diisocyanate. Hexamethylene diisocyanate is particularly preferable in view of a hue of the aliphatic glycol/polybasic acid type polyester obtained and a reactivity in incorporating into the above-described prepolymer.

Amount of the above-described coupling agent to be used is 0.1 to 5 parts by weight, preferably 0.5 to 3 parts by weight based on 100 parts by weight of the above-described prepolymer. An amount less than 0.1 parts by weight results in an insufficient coupling reaction, whereas an amount above 5 parts by weight tends to cause a gelation.

Moreover, the above-described aliphatic glycol/polybasic acid type polyester may be a modified polyester in which terminal hydroxyl groups are capped by other compounds via double bond, urethane bond or urea bond, or a degenerated aliphatic glycol/polybasic acid type polyester.

Aliphatic polyesters, which are condensed products of polyvalent alcohols and polybasic acids, practically available on the market include, for example, polybutylene succinate (PBS) and polyethylene succinate (PES).

Polybutylene succinate (PBS) type aliphatic polyesters include, for example, polybutylene succinate (PBS) consisting of butanediol and succinic acid, or adipate copolymer (PBSA) in which adipic acid is copolymerized therein, and further an adipate/terephthalate copolymer in which terephthalic acid is copolymerized therein, to facilitate biodegradability. Commercially available products include, for example, "Bionolle" (trade name) from Showa Highpolymer Co., Ltd., "EnPol" (trade name) from Elle Chemical Ltd., "Ecoflex" (trade name) from BASF A. G. and "Biomax" (trade name) from Du Pont Co.

Further, polyethylene succinate (PES) has also been available on the market, and commercial products thereof include, for example, "Runare SE" (trade name) from Nippon Shokubai Co., Ltd.

(3) Aliphatic Polyesters Produced by Microorganisms

Certain kinds of microorganisms accumulate polyester materials in their cells. Polyester materials produced by microorganisms are thermoplastic polymers having organism-derived melting point. And such polymers are decomposed by an enzyme, extracellularly secreted from the microorganisms in nature, and the decomposed products are consumed by microorganisms until complete extinction.

Such (aliphatic) polyesters produced by microorganisms include polyhydroxybutyrate (PHB), and copolymers such as poly(hydroxybutyric acid-hydroxylpropionic acid) and poly(hydroxylbutyric acid-hydroxyvaleric acid).

(4) Polycaprolactone Type Aliphatic Polyesters

Polycaprolactone, which is a kind of an aliphatic polyester, can be obtained by ring opening polymerization of ϵ-caprolactone, and decomposed by various bacteria in spite of a water-insoluble polymer.

Polycaprolactone is an aliphatic polyester represented by the general formula: $—(O(CH_2)_5CO)_n—$, and a commercial product of such a polycaprolactone type aliphatic polyester includes, for example, "Tone" (trade name) from Nippon Unicar Co., Ltd.

As a biodegradable plastic used in a fiber (A), the above-described biodegradable plastics may be used as they are or in combination of two or more types mixed in arbitrary ratio.

A stabilizer against hydrolysis according to the present invention is used in an amount wherein improving effect of hydrolysis resistance of a biodegradable plastic can be available. Also, in case where a carbodiimide compound or a carbodiimide composition is used as a stabilizer against hydrolysis, it is preferable to be used in an amount wherein improving effect of hydrolysis resistance can be available. A formulated amount of the carbodiimide compound or the carbodiimide composition is preferably 0.1 to 5 parts by weight, particularly preferably 0.5 to 3 parts by weight, based on 100 parts by weight of the biodegradable plastic.

Concerning yellowing resistance, a carbodiimide compound may show coloring in synthesis thereof, but also yellowing proceeds in adding to a biodegradable plastic due to heat or thermal oxidation.

After a fiber has been formed, a carbodiimide compound shows yellowing due to heat, $NO_x$, sunshine, and the like, by which a fiber shows yellowing. This yellowing becomes stronger, with increase in the addition amount of a carbodiimide compound in a biodegradable.

In the case where a carbodiimide composition according to the present invention is used, it is preferable to be used in an amount wherein improving effect of yellowing resistance can be obtained. It is preferably used in 0.1 to 5 parts by weight, particularly preferably 0.5 to 3 parts by weight, baseed on 100 parts by weight of the biodegradable plastic.

3. Other Additives

A biodegradable plastic composition of the present invention may contain, in addition to a stabilizer against hydrolysis of the present invention, additives usually added to synthetic fiber such as antioxidants of amine type or phenol type, heat stabilizers, hindered amine type light stabilizers, UV absorbing agents, as well as flame retardants, antistatic agents, pigments, dyes, lubricants, crystallization accelerators, inorganic fillers, colorants, polymers other than biodegradable plastics or particles, organic degradable materials such as starch or the like, within a range not to impair the effects of the present invention.

4. A Fiber (A) and a Production Method Thereof

A fiber (A) according to the present invention preferably has concentration of total terminal carboxyl groups in the fiber (A) not higher than 5 equivalents/ton, preferably not higher than 1 equivalent/ton, based on based on the fiber (A), since hydrolysis resistance of a fiber article according to the present invention can be dramatically improved. This can be attained by formulating the above-described stabilizer against hydrolysis into a biodegradable plastic.

Concentration of total terminal carboxyl groups is determined by taking out a predetermined amount of a fiber, followed by dissolving by the addition of chloroform, the addition of a proper amount of benzyl alcohol, and titrating with a 0.005 N ethanol solution of KOH.

The fiber (A) has preferably strength of not lower than 2.0 cN/dtex to retain adaptability in passing processing stages and sufficiently high mechanical strength. The strength is more preferably not lower than 3.5 cN/dtex. And when elongation is 15 to 70%, it is preferable since adaptability in passing processing stages in production of a fiber article is improved. Elongation is more preferably 25 to 50%.

Further, boiling shrinkage of the fiber (A) from 0 to 20% is preferable due to providing good dimensional stability of a fiber and a fiber article. Boiling shrinkage is more preferably 3 to 10%

As to a sectional shape of a fiber, a circular section, a hollow section, a multi-leaves section such as a three-leaves section, and other profile section may be freely selected. A fiber shape and form such as a long fiber, a short fiber, and the like are not specially limited, and as a long fiber, either a multi-filament or a monofilament may be used.

Next, a method for producing the fiber (A) according to the present invention is not specially limited, and for instance, the following method may be adopted.

First of all, a stabilizer against hydrolysis such as the above-described carbodiimide compound is produced.

A biodegradable plastic, for example, polylactic acid (polylactide) type aliphatic polyester, and the like is produced by a known method, and a case where the biodegradable plastic is polylactic acid is explained here. It is preferable for polylactic acid to have good color and an amount of a residual oligomers or monomers of lactide, and the like is reduced. As specific means, it is preferable to use an deactivation agent of a metal, an antioxidant, and the like, to lower polymerization temperature, and to suppress the addition ratio of a catalyst. Further, by treating a polymer under reduced pressure or extracting it with chloroform, and the like, the amount of residual oligomers and monomers can be largely reduced.

Next, polylactic acid and a stabilizer against hydrolysis are kneaded. The first kneading method is supplying dried polylactic acid and a stabilizer against hydrolysis to a kneading extruder sealed with nitrogen, followed by introducing molten liquid of thus kneaded polylactic acid and the stabilizer against hydrolysis by the kneading extruder to a spinning machine, further fine kneading with a stationary kneader equipped with a spinning pack and then discharging molten spun yarn from a nozzle.

The second kneading method is separately melting of polylactic acid and a stabilizer against hydrolysis, followed by introducing molten liquid of thus kneaded polylactic acid and the stabilizer against hydrolysis by the kneading extruder to a spinning machine, further fine kneading with a stationary kneader equipped with a spinning pack and then discharging molten spun yarn from a nozzle.

In this connection, when residence time of a stabilizer against hydrolysis at 200 to 250° C. in kneading, melt spinning and in a spinning machine is set within 30 min., preferably within 20 min., thermal deterioration can be suppressed and thus preferable. Residence time of a stabilizer against hydrolysis at 200 to 250° C. here, means time for passing a section heated substantially at 200 to 250° C., which can be estimated from temperature set of a kneader or a melting section, pipeline size, spinning pack dimension, and the like. Therefore, it is preferable to make space in the spinning pack as small as possible. Kneading temperature and spinning temperature are preferably set at 210 to 250° C., more preferably at 210 to 230° C.

Therefore, it is preferable to contrive also an addition method for a stabilizer against hydrolysis, and rather than preliminarily making a chip of polylactic acid added with a stabilizer against hydrolysis, it is preferable to directly add a stabilizer against hydrolysis during melt spinning. For instance, a stabilizer against hydrolysis may be added at a melting section of polylactic acid, or a stabilizer against hydrolysis and polylactic acid separately melted may be mixed in a spinning pack with a static kneader.

After cooling and solidifying a filament by a chimney, an oil solution for a fiber mainly comprising a smoothing agent such as an aliphatic polyester and mineral oil, is fed with an oiling guide or an oiling roller. Then, the filament is drawn with a roller.

For producing a long filament, the filament drawn is once wound as a cheese package, then it is stretched and heat-treated. This time, when a spinning rate which is a peripheral speed of the first drawing roll, is set to 2500 to 7000 m/min, non-uniformity of a filament is reduced and thus preferable. When stretching temperature is set at 80 to 150° C., non-uniformity of a filament is reduced and thus preferable. Stretching temperature is more preferably at 120 to 150° C. Setting of heat-treatment temperature at 120 to 160° C. is preferable, since boiling shrinkage of a filament of polylactic acid is reduced and thermal dimension stability is improved. Heat-treatment temperature is more preferably 130 to 150° C. In this connection, when high strength is required as in industrial materials applications, multi-stage stretching may be conducted. Optionally, a polylactic acid filament may be subjected to crimping by false twisting processing, indentation processing, mechanical crimping, and the like.

On the other hand, for producing a short filament, a drawn filament is assembled, and after it is once received in a bunker, it is further assembled to form a tow, followed by subjecting to stretching and mechanical crimping, the addition of a lubricant suitable at the next stage and cutting. During stretching, considering poor thermal conduction of a thick tow, it is preferable to adopt stretching with steam or stretching in a liquid bath. It is preferable to set temperature here at 75 to 100° C.

Further, for producing an unwoven fabric, the above-described short filament may be used, or such a method may be used wherein spinning by so-called spun bonding, melt blowing, and the like and a stage of unwoven fabric forming are consecutive.

A fiber (A) according to the present invention may adopt various fiber article forms, such as a molded cup article, and the like, besides a fabric, a knit, and an unwoven fabric, and the like.

II. A Fiber (B)

A fiber (B) according to the present invention is at least one type of fiber selected from a natural fiber, a regenerated fiber, a semisynthetic fiber and a synthetic fiber. A fiber material (stock) is selected, as appropriate, depending upon applications of a fiber article having excellent hydrolysis resistance.

1. A natural fiber

A natural fiber includes cotton, hemp, kenaf, banana, pineapple, wool, silk, Angora, cashmere, and the like.

2. A regenerated fiber

A regenerated fiber includes rayon, cuprammonium rayon, polynosic, high wet modulus rayon, a solvent spun cellulose fiber, and the like.

3. A semisynthetic fiber

A semisynthetic fiber includes viscose, acetate, promix fiber, and the like.

4. A synthetic fiber

A synthetic fiber includes a polyester type fiber, a polyamide type fiber, a polyacrylonitrile type fiber, a polypropylene type fiber, a polyurethane fiber, a polyvinyl chloride type fiber, a benzoate fiber, and the like.

III. Fiber Structure

Fiber structure according to the present invention comprises 10 to 90% by weight of the above-described fiber (A) and 90 to 10% by weight of the above-described at least one fiber (B) selected from a natural fiber, a regenerated fiber, a semisynthetic fiber and a synthetic fiber. For instance, for mixed use as a cloth, when ratio for mixed use of the fiber (A) is set not lower than 30% by weight, preferably not lower than 50% by weight, characteristics of the fiber (A) is exhibited and thus preferable.

As mixed use embodiments, those obtained by mixing, mixed weaving, mixed knitting, or entangling the fiber (A) and the fiber (B), for example, between a natural fiber such as silk, cotton, and the like, with a regenerated fiber such as rayon, acetate, and the like, are exemplified. Specific examples thereof include a mixed filament, a conjugated filament, a conjugated and false twisted filament, a mixedly spun filament, a conjugated filament of a long filament and a short filament, a fluid processed filament, a covering yarn, assembling, mixed weaving, mixed knitting, a pile interlaced material, mixed cotton, bat wool, a mixed unwoven cloth of a long fiber and a short fiber and felt. In this connection, a conjugated filament may contain a fiber spun in any one of methods of a mixed filament, a multi-structure filament, a mixed twisted filament, or a mixed entangled filament. The fiber (A) and the fiber (B) may each be one kind of fiber, or may mixed fiber of at least two kinds of fibers at arbitrary ratio.

Further, the fiber structure may take various forms of fiber articles including a filament form such as a sewing yarn, an embroidery thread, strings, and the like; a cloth form such as a woven material, a knitted material, knit, an unwoven cloth, felt, and the like; exterior wear such as a coat, a sweater, and the like; a garment article such as underwear, panty stockings, socks, back fabric, inner lining, garments for sporting, and the like; a living material article such as a curtain, a carpet, a chair covering, a bag, a furniture covering, a wall covering, various kinds of belts, a sling, and the like; an industrial material article such as a sail cloth, a net, a rope, a heavy cloth, and the like; and an artificial leather article; and the like.

IV. A Fiber Article

A fiber article with excellent hydrolysis resistance according to the present invention is characterized in that the article is the above-described fiber structure which has been subjected to at least one processing treatment selected from scouring processing, bleaching processing, liquid ammonium processing, mercerization processing, biological processing, dyeing processing, or resin treatment, and concentration of total terminal carboxyl groups derived from the fiber (A) in said fiber article is not higher than 30 equivalents/ton based on the fiber (A).

Usually, when fiber structure comprising a biodegradable plastic is subjected to any of the above-described processing treatments, the fiber structure is hydrolyzed, and due to decrease in strength, durability problems of a fiber article are generated, however, a fiber article according to the present invention can solve the problems by setting concentration of total terminal carboxyl groups derived from the fiber (A) in the fiber article is not higher than 30 equivalents/ton, preferably not higher than 10 equivalents/ton, more preferably not higher than 1 equivalent/ton, based on the fiber (A).

In the present invention, hydrolysis resistance can be evaluated by retention ratio of fiber strength, and in the present invention, it was evaluated by tensile strength of weft yarn and washing durability (tumbling drying according to JIS L1042, a method F-2), namely, by a retention ratio (%) of tensile strength of weft yarn after 50 times of washing. The retention ratio (%) of tensile strength of weft yarn after 50 times of washing is preferably not lower than 60%, more preferably not lower than 80%.

Scouring, one of the above-described processing treatments, is a step to remove foreign matters including cotton wax contained in a cotton fiber, oils and fats, pectin, a protein and a spinning oil. A cotton fabric after removing sizing substance and before scouring has no water absorbability due to wax, and the like residing at the surface of a fiber, and scouring level to remove them greatly influences on processing which follows. In scouring of cotton, an alkali solution as a main agent and a surfactant as an auxiliary are used. Cotton is resistant to an alkali solution, and is thus generally treated with hot caustic soda. Caustic soda saponifies or hydrolyzes foreign matters, but to sufficiently remove such saponified matters or degraded matters from a fiber, assistance of emulsifying and dispersing power of a surfactant is required.

Bleaching is a step to degrade and remove organic materials contained in a filament or a woven or knitted article. A cotton cloth after scouring shows so-called raw color, and by enhancing whiteness by bleaching, a white article and dyed or printed materials having clear color cans be obtained. A bleaching agent includes an oxidizing agent and a reducing agent, and for bleaching of cotton, oxidizing agents such as hydrogen peroxide, sodium chlorite, sodium hypochlorite, and the like are used.

Further, mercerization processing, also called as silket processing, is a treating processing of a cloth (or a filament) made of cotton with caustic soda under tension. When cotton contacts with a strong alkali solution (in this case, caustic soda solution) at comparatively low temperature, a fiber thereof: swells, twisting of the fiber disappears, and a surface thereof becomes smooth. Then, a sectional shape of each filament, which had a flat shape originally, swells and at the same time deformed to an approximately circular form, and therefore at the same time when appropriate tension is applied to a cloth (or a filament), smoothness at fiber surface is increased and luster is enhanced. Silketting is a step to treat a cotton cloth with a strong caustic soda solution (for example, not lower than 20%) under tension to provide silk-like luster and therefore it is so named. In mercerization processing (for silket), functions to change fine fiber structure occur, besides providing luster, increasing absorbing amount of dyes or chemicals, and thus enhancing dyeing and fiber strength and dimension stability.

Liquid ammonium processing is a treatment with liquid ammonium besides caustic soda in the above-described silket processing, and significantly improves feeling of bulge and a wrinkle resistance. As liquid ammonium has lower viscosity and surface tension than water, it easily penetrates to an inner part of a cotton fiber, and a reaction is completed in about several seconds, and further the reaction is uniform. When cotton is immersed in liquid ammonium, cotton in flat and twisted state instantly swells, and becomes a circular shape, and twisting thereof disappears. By liquid ammonium processing, cotton can obtain such effects as (I) it hardly crimps, (ii) it hardly wrinkles, (iii) each filament increases repulsion, (iv) it becomes soft, (v) it becomes strong, and the like, and when the processing is combined with resin treatment, excellent crimp resistance and wrinkle resistance can be obtained.

Generally, when a cotton fiber is made to swell by silket processing or liquid ammonium processing, luster, hand feeling, strength and elongation are improved. Moreover, reactivity with a dye or a processing agent is enhanced, and morphological stability is increased. Usually, processing is conducted in cloth state, but it can be conducted even in filament or raw cotton stage.

Bio-processing is a fiber process using an enzyme, for instance, by a cellulase enzyme to beautifully finish a natural material such as cotton, hemp, rayon, TENCEL®, and the like utilizing natural power (biopower). Almost all of enzymes industrially utilized are produced by mass culturing of a natural microbe such as bacteria, a fungus, and the like, which can replace a chemical treatment at high temperature, in a strong alkali or a strong acid, or under high pressure, to a mild reaction. By changing these processings to action of an enzyme, they can be changed to processings mild to a fiber and nature, along with safe working environment. For example, a pectin degradable enzyme instead of caustic soda for scouring, and an oxidizing enzyme instead of bleaching are utilized.

As for dyeing processing, a fiber material is immersed in a dye solution in which a dye has been dissolved and dispersed, thus a dye is absorbed, thereafter it is fixed by heating or chemical treatment, an excess dye attached to fiber surface is removed by washing, and further a post-treatment for enhancing fastness is conducted, and thus the processing is completed. A method for dyeing is briefly classified to a non-continuous method (a batch dyeing method and a dust collecting method) and a continuous method (a padding method), and the present invention can adopt both of them.

Resin treatment is one of finishing processings of such as a woven fabric. For instance, cotton has excellent water absorbability and comfortable touch feeling, but on the contrary has drawback of easy wrinkling in laundering. To supplement this drawback, a resin treatment is conducted to furnish wrinkling resistance and crimp resistance. Usually, a resin treating machine is used and the machine components include (i) a padder providing a processing agent, (ii) a preliminary dryer which dries about 60% of water content provided by the padder to about 30%, (ii) a tenter for drying while tentering, (iv) a baking machine for heat treatment, and (v) a water rinsig and drying machine for soaping.

A fiber article with excellent hydrolysis resistance and durability according to the present invention can suitably be used in applications not only as garment applications such as a shirt, a blouson and pants but also a clothing materials such as a cup and a pad; an interior applications or vehicle parts applications such as a curtain, a carpet, a mat, a wall paper, furniture; an industrial material article such as a belt, a net, a rope, a heavy fabric, a bag and a sewing thread; a felt, a non-woven fabric, a filter, artificial lawn, etc.

EXAMPLES

The present invention is explained in more detail below using EXAMPLES. Properties in EXAMPLES are measured and evaluated by the following methods.

Concentration of Terminal Carboxyl Groups

To remove flushing agents and smear attached on a fiber article, the fiber article just fabricated was washed in accordance with JIS L1042, a method F-2 and then press dried. From this fiber article, a specified amount of a fiber containing a biodegradable plastic was taken out, followed by dissolving by the addition of chloroform, taking out only dissolved portion, the addition of the appropriate amount of benzyl alcohol and titration with a 0.005 N KOH ethanol solution to determine concentration of terminal carboxyl groups. For mixed spun fibers, and the like, concentration of terminal carboxyl groups was determined by consideration of mixing ratio.

Tensile Strength of Weft Yarn

Tensile strength of weft yarn was calculated in accordance with "Tensile strength of JIS L1096, a method A" (based on measurement in weft yarn direction).

Washing Durability

Washing durability was evaluated as retention ratio of tensile strength of weft yarn (%) after 50 times of washing by the following equation, after tumble drying in accordance with JIS L1042, a method F-2: Retention ratio of tensile strength of weft yarn (%)=100×(strength of weft yarn after 50 times of washing/strength of weft yarn just after fabrication)

Yellowing Index (YI)

Yellowing index (YI) was measured based on measurement conditions specified by JIS K7103. A color difference analyzer, "model NF333" from Nippon Denshoku Ind. Co., Ltd. was used. For reference, b* value and b value were also calculated as color hue index.

Synthesis of the carbodiimide compounds for the present invention is described before EXAMPLES and COMPARATIVE EXAMPLES of a carbodiimide composition.

Synthesis Example 1

100 parts by weight of 4,4'-dicydohexylmethane diisocyanate, 0.5 part by weight of 3-methyl-1-phenyl-2-phospholene-1-oxide and 1 part by weight of bis-(2,4-di-t-butylphenyl) pentaerythritol diphosphite were charged in a flask equipped with a stirrer motor, a nitrogen gas bubbling tube and a cooling pipe to be subjected to a carbodiimidation reaction at 185° C. for 24 hours with nitrogen gas bubbling. Carbodiimide obtained had NCO % of 2.4.

Example 1

A plain weave fabric having density of 131 warp yarns/inch and 67 weft yarns/inch was prepared using 100% cotton 40S as warp yarn and 150 d polylactic acid filament added with 1% of a polycarbodiimide compound, "CARBODILITE LA-1" from Nisshinbo Ind. Inc., as weft yarn.

Thus obtained plain weave fabric was pad steam treated at 90° C. using continuous scouring and bleaching equipment in accordance with a conventional method for cotton/polyester mixed fabric. Then, in accordance with a conventional method, it was subjected to silket processing, liquid ammonium processing, dyeing polylactic acid fibers at 110° C. using a jet dyeing machine in accordance with a conventional method and then dyeing cotton at 85° C. and resin processing with a glyoxal based resin in accordance with a conventional method.

Cloth obtained had superior feeling and vivid color expression as garment application. Composition used and evaluation results are shown in Table 1.

Example 2

A cloth was prepared similarly as Example 1 except that weft yarn in Example 1 was changed to 150 d polylactic acid filament added with 3% of a polycarbodiimide compound, "CARBODILITE LA-1" from Nisshinbo Ind. Inc.

Cloth obtained had superior feeling and vivid color expression as garment application. Composition used and evaluation results are shown in Table 1.

Example 3

A cloth was prepared similarly as Example 1 except that weft yarn in Example 1 was changed to PLA/cotton=65/35 mixed spun fiber 40S added with 1% of a polycarbodiimide compound, "CARBODILITE LA-1" from Nisshinbo Ind. Inc., and a plain weave was changed to have 71 weft yarns/inch.

Cloth obtained had superior feeling and vivid color expression as garment application. Composition used and evaluation results are shown in Table 1.

Example 4

A cloth was prepared similarly as Example 1 except that warp yarn and weft yarn in Example 1 were changed to PLA/cotton=30/70 40S added with 1% of a polycarbodiimide compound, "CARBODILITE LA-1" from Nisshinbo Ind. Inc., and two layer structured yarn, respectively and a plain weave was changed to have density of 131 warp yarns/inch and 71 weft yarns/inch.

Cloth obtained had superior feeling and vivid color expression as garment application. Composition used and evaluation results are shown in Table 1.

Comparative Example 1

A cloth was prepared similarly as Example 1 except that 150 d polylactic acid filament not containing a polycarbodiimide compound was used as weft yarn.

Cloth obtained had too low tensile strength to be used as practical garment application. Composition used and evaluation results are shown in Table 1.

Comparative Example 2

A cloth was prepared similarly as Example 1 except that 150 d polylactic acid filament added with 0.5% of a polycarbodiimide compound, "CARBODILITE HMV-8CA" from Nisshinbo Ind. Inc., was used as weft yarn.

Cloth obtained had too low tensile strength to be used as practical garment application. Composition used and evaluation results are shown in Table 1.

Example 5

A plain weave fabric having density of 131 warp yarns/inch and 67 weft yarns/inch was prepared using 100% cotton 40S as warp yarn and 150 d poly(butylene succinate) filament added with 1% of "Synthesis Example 1", a carbodiimide composition containing the above-synthesized carbodiimide compound, as weft yarn.

Thus obtained plain weave fabric was pad steam treated at 90° C. using continuous scouring and bleaching equipment in accordance with a conventional method for cotton/polyester mixed weave fabric. Then, in accordance with a conventional method, it was subjected to silket processing, liquid ammonium processing, dyeing poly(butylene succinate) fibers at 110° C. using a jet dyeing machine in accordance with a conventional method and then dyeing cotton at 85° C. and resin processing with a glyoxal based resin in accordance with a conventional method.

Cloth obtained had superior feeling and vivid color expression as garment application. Composition used and evaluation results are shown in Table 2.

Example 6

A plain weave fabric having density of 130 warp yarns/inch and 81 weft yarns/inch was prepared using 100% polynosic 30S as warp yarn and 150 d polylactic acid filament added with 1% of a polycarbodiimide compound, "CARBODILITE LA-1" from Nisshinbo Ind. Inc., as weft yarn.

Thus obtained plain weave fabric was pad steam treated at 90° C. using continuous desizing and scouring equipment in accordance with a conventional method for polynosic/polyester mixed weave fabric. Then, in accordance with a conventional method, it was subjected to liquid ammonium processing, dyeing polylactic acid fibers at 110° C. using a jet dyeing machine after conventional bio processing at 55° C. and then dyeing cotton at 85° C. and resin processing with a glyoxal based resin in accordance with a conventional method.

Cloth obtained had superior feeling and vivid color expression as garment application. Composition used and evaluation results are shown in Table 2.

Example 7

A plain weave fabric having density of 131 warp yarns/inch and 67 weft yarns/inch was prepared using cotton/polytrimethylene terephthalate (PTT)=50/50 mixed spun fiber 40S as warp yarn and 150 d polylactic acid filament added with 1% of a polycarbodiimide compound, "CARBODILITE LA-1" from Nisshinbo Ind. Inc., as weft yarn.

Thus obtained plain weave fabric was pad steam treated at 90° C. using continuous scouring and bleaching equipment in accordance with a conventional method for cotton/polyester mixed weave fabric. Then, in accordance with a conventional method, it was subjected to silket processing, liquid ammonium processing, dyeing polylactic acid fibers at 110° C. using a jet dyeing machine in accordance with a conventional method and then dyeing cotton/polytrimethylene terephthalate at 85° C. and resin processing with a glyoxal based resin in accordance with a conventional method.

Cloth obtained had superior feeling and vivid color expression as garment application. Composition used and evaluation results are shown in Table 2.

Evaluation results including yellow index (YI), and the like of a carbodiimide composition containing a carbodiimide compound used are shown in Table 3.

TABLE 1

| | Example 1 | Example 2 | Example 3 | Example 4 | Comparative Example 1 | Comparative Example 2 |
|---|---|---|---|---|---|---|
| Biodegradable plastic | Polylactic acid | Polylactic acid | Polylactic acid | Polylactic acid | Polylactic acid | Polylactic acid |
| Fabric composition | Warp cotton 100 | Warp cotton 100 | Warp cotton 100 | Warp PLA/Cotton = 30/70 | Warp cotton 100 | Warp cotton 100 |
| | Weft PLA 100 | Weft PLA 100 | Weft PLA/Cotton = 65/35 | Weft PLA/Cotton = 30/70 | Weft PLA 100 | Weft PLA 100 |
| CARBODILITE HMV-8CA | 0.0 | 0.0 | 0.0 | 0.0 | 0.0 | 0.5 |
| CARBODILITE LA-1 | 1% | 3% | 1% | 1% | 0% | 0% |
| Processing | | | | | | |
| Scouring | ○ | ○ | ○ | ○ | ○ | ○ |
| Bleaching | ○ | ○ | ○ | ○ | ○ | ○ |
| Silket | ○ | ○ | ○ | ○ | ○ | ○ |
| Liquid ammonia | ○ | ○ | ○ | ○ | ○ | ○ |
| Dyeing | ○ | ○ | ○ | ○ | ○ | ○ |
| Resin | ○ | ○ | ○ | ○ | ○ | ○ |
| Conc. terminal carboxyl group | 0.3 | 0.1 | 0.2 | 0.4 | 58 | 43 |
| Tensile strength of weft yarn | 35 kN | 37 kN | 29 kN | 28 kN | 6 kN | 10 kN |
| Washing durability | 93% | 100% | 93% | 88% | 0% | 0% |

Tensile strength of weft yarn: JIS L1096, method A (measurement in weft yarn direction)

Washing durability: JIS L1096, method F-2

Retention ratio of weft yarn tensile strength after 50 times of washing (%) = (weft yarn tensile strength after 50 times of washing/weft yarn tensile strength just after fabrication) × 100

TABLE 2

| | Example 5 | Example 6 | Example 7 |
|---|---|---|---|
| Biodegradable plastic | Polybutylene succinate | Polylactic acid | Polylactic acid |
| Fabric composition | Warp cotton 100 | Warp polynosic 100 | Warp Cotton/ PTT = 50/50 |
| | Weft PBS 100 | Weft PLA 100 | Weft PLA 100 |
| SYNTHESIS EXAMPLE 1 | 1.0 | 0.0 | 0.0 |
| CARBODILITE LA-1 | 0% | 1% | 1% |
| Processing | | | |
| Scouring | ○ | ○ | ○ |
| Bleaching | ○ | — | ○ |
| Silket | ○ | — | ○ |
| Liquid ammonia | ○ | ○ | ○ |
| Bio | — | ○ | — |
| Dyeing | ○ | ○ | ○ |
| Resin | ○ | ○ | ○ |
| Conc. terminal carboxyl group | 0.7 | 0.2 | 0.4 |
| Tensile strength of weft yarn | 23 kN | 39 kN | 28 kN |

TABLE 3

| | Carbodiimide compound (composition) | | |
|---|---|---|---|
| | CARBODILITE (from Nisshinbo Ind. Inc.) | | SYNTHESIS |
| | LA-1 | HMV-8CA | EXAMPLE 1 |
| YI | 3.306 | 12.378 | 5.7 |
| b | 1.664 | 6.003 | 2.618 |
| b* | 1.745 | 6.35 | 2.775 |

As is clear from the results of Examples and Comparative Examples shown in Tables 1 to 3, it was found that in Examples 1 to 7, which are a fiber article, characterized in that the article is fiber structure composed of 10 to 90% by weight of a fiber (A) comprised of a biodegradable plastic formulated with a carbodiimide compound as a stabilizer against hydrolysis and 90 to 10% by weight of at least one fiber (B) selected from a natural fiber, a regenerated fiber, a semisynthetic fiber and a synthetic fiber, which fiber structure has been subjected to at least one treatment processing selected from scouring processing, bleaching processing, liquid ammonium processing, mercerization processing, biological processing, dyeing processing, or resin treatment, and concentration of total terminal carboxyl groups derived from a fiber (A) in the fiber article was not higher than 30 equivalents/ton based on the fiber (A), preferably not higher than 1 equivalent/ton, tensile strength of weft yarn and washing durability were significantly improved compared with Comparative Examples 1 and 2, wherein concentration of total terminal carboxyl groups derived from a fiber (A) in a fiber article was over 30 equivalents/ton based on the fiber (A).

A fiber article of the present invention, that is a fiber article furnished with superior hydrolysis resistance, alkali resistance and dyeing resistance by formulating a stabilizer against hydrolysis comprising a carbodiimide compound, into a fiber using a biodegradable plastic, is suitably used not only as garment applications but also a clothing materials such as a cup and a pad; an interior applications or vehicle parts applications such as a curtain, a carpet, a mat, a wall paper, furniture; an industrial material article such as a belt, a net, a rope, a heavy fabric, a bag and a sewing thread; a felt, a non-woven fabric, a filter, artificial lawn, etc.

What is claimed is:

1. A fiber article having excellent hydrolysis resistance, characterized in that the article is fiber structure composed of 10 to 90% by weight of a fiber (A) comprised of a biodegradable plastic formulated with a carbodiimide compound as a stabilizer against hydrolysis and 90 to 10% by weight of at least one fiber (B) selected from a natural fiber, a regenerated fiber, a semisynthetic fiber and a synthetic fiber, which fiber structure has been subjected to at least one treatment processing selected from scouring processing, bleaching processing, liquid ammonium processing, mercerization processing, biological processing, dyeing processing, or resin treatment, and concentration of total terminal carboxyl groups in said fiber (A) is not higher than 30 equivalents/ton based on the fiber (A).

2. The fiber article having excellent hydrolysis resistance according to claim 1, characterized in that concentration of total terminal carboxyl groups in the fiber (A) is not higher than 1 equivalent/ton based on the fiber (A).

3. The fiber article having excellent hydrolysis resistance according to claim 1, characterized in that the stabilizer against hydrolysis has yellow index (YI) of not higher than 10.

4. The fiber article having excellent hydrolysis resistance according to claim 3, characterized in that the carbodiimide compound is an aliphatic polycarbodiimide compound.

5. The fiber article having excellent hydrolysis resistance according to claim 1, characterized in that the stabilizer against hydrolysis further contains an antioxidant.

6. The fiber article having excellent hydrolysis resistance according to claim 5, characterized in that the antioxidant is at least one kind of a hindered phenol-based antioxidant or a phosphorus-based antioxidant.

7. The fiber article having excellent hydrolysis resistance according to claim 1, characterized in that the stabilizer against hydrolysis is formulated in ratio of 0.01 to 5 parts by weight based on 100 parts by weight of the biodegradable plastic.

8. The fiber article having excellent hydrolysis resistance according to claim 1, characterized in that the biodegradable plastic is an aliphatic polyester.

9. The fiber article having excellent hydrolysis resistance according to claim 1, characterized in that the biodegradable plastic is one obtained from a biomass raw material.

* * * * *